US011705009B2

(12) United States Patent
Liberko et al.

(10) Patent No.: US 11,705,009 B2
(45) Date of Patent: Jul. 18, 2023

(54) SYSTEM AND METHOD FOR OPTIMIZING MISSION FULFILLMENT BY UNMANNED AIRCRAFT SYSTEMS (UAS) VIA DYNAMIC ATMOSPHERIC MODELING

(71) Applicant: Rockwell Collins, Inc., Cedar Rapids, IA (US)

(72) Inventors: Nicholas Liberko, Marion, IA (US); Kevin McElroy, Vint Hill Farms, VA (US); Boe A. Svatek, Cedar Rapids, IA (US); Brian R Wolford, Cedar Rapids, IA (US); Kevin M Kronfeld, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 132 days.

(21) Appl. No.: 17/496,552

(22) Filed: Oct. 7, 2021

(65) Prior Publication Data

US 2022/0028283 A1 Jan. 27, 2022

Related U.S. Application Data

(63) Continuation-in-part of application No. 17/067,431, filed on Oct. 9, 2020, now Pat. No. 11,345,473, which (Continued)

(51) Int. Cl.
*G08G 5/00* (2006.01)

(52) U.S. Cl.
CPC ..... *G08G 5/0034* (2013.01); *G08G 5/006* (2013.01); *G08G 5/0039* (2013.01); *G08G 5/0069* (2013.01); *G08G 5/0091* (2013.01)

(58) Field of Classification Search
CPC .... G08G 5/0034; G08G 5/0039; G08G 5/006; G08G 5/0069; G08G 5/0091; G08G 5/0026
See application file for complete search history.

(56) References Cited

U.S. PATENT DOCUMENTS 5,111,400 A 5/1992 Voder
6,044,323 A 3/2000 Yee et al.
(Continued)

FOREIGN PATENT DOCUMENTS

EP 3832426 A1 6/2021
GB 2569789 A 7/2019
(Continued)

OTHER PUBLICATIONS

Extended Search Report for European Application No. 20212277.6 dated Apr. 29, 2021, 5 pages.

*Primary Examiner* — Andrew W Bee
(74) *Attorney, Agent, or Firm* — Suiter Swantz pc llo

(57) ABSTRACT

A system and method for optimizing mission fulfillment via unmanned aircraft systems (UAS) within a mission space generates or receives atmospheric models forecasting weather and wind through the mission space, the atmospheric models having an uncertainty factor. Until the projected flight time, the controller may iterate through one or more simulations of a projected flight plan through the mission space, determining the probability of successful fulfillment of mission objectives based on the most current atmospheric models (including the ability of the UAS to navigate the flight plan within authorized airspace constraints). Based on conditions and behaviors observed during a simulated flight plan, the controller may revise flight plans, flight times, or atmospheric models for subsequent simulations. Based on multiple probabilities of fulfillment across multiple simulations, the controller selects an optimal flight plan and/or flight time for fulfillment of the assigned set of mission objectives.

14 Claims, 7 Drawing Sheets

Related U.S. Application Data is a continuation-in-part of application No. 16/704,742, filed on Dec. 5, 2019, now Pat. No. 11,423,789.

(56) References Cited

U.S. PATENT DOCUMENTS

| | | | | |
|---|---|---|---|---|
| 8,600,602 | B1 | 12/2013 | McAndrew et al. | |
| 8,798,922 | B2 | 8/2014 | Tillotson et al. | |
| 9,026,275 | B1 * | 5/2015 | Young | G08G 5/003 701/122 |
| 9,273,981 | B1 | 3/2016 | Downey et al. | |
| 9,558,670 | B1 * | 1/2017 | Sheth | G08G 5/006 |
| 9,715,235 | B2 | 7/2017 | McGrew et al. | |
| 9,754,496 | B2 | 9/2017 | Chan et al. | |
| 9,959,771 | B1 | 5/2018 | Carlson | |
| 10,049,583 | B2 | 8/2018 | Salentiny et al. | |
| 10,049,590 | B2 | 8/2018 | Thiele et al. | |
| 10,163,357 | B2 | 12/2018 | Venkatraman et al. | |
| 10,223,924 | B2 | 3/2019 | Wang et al. | |
| 10,421,543 | B2 | 9/2019 | Liu et al. | |
| 10,438,494 | B1 | 10/2019 | Hahn | |
| 10,466,700 | B1 | 11/2019 | Carmack et al. | |
| 10,656,643 | B1 | 5/2020 | Bertram et al. | |
| 10,776,744 | B1 * | 9/2020 | Kimchi | G08G 5/0026 |
| 10,976,752 | B2 | 4/2021 | Venturelli | |
| 11,046,430 | B1 | 6/2021 | Melton et al. | |
| 2011/0231036 | A1 | 9/2011 | Yogesha et al. | |
| 2013/0226373 | A1 * | 8/2013 | Bollapragada | G06Q 10/047 701/3 |
| 2015/0197010 | A1 | 7/2015 | Ruuspakka et al. | |
| 2015/0339932 | A1 | 11/2015 | Ramanna et al. | |
| 2016/0232795 | A1 | 8/2016 | Thiele et al. | |
| 2017/0108866 | A1 | 4/2017 | Quinn | |
| 2018/0090016 | A1 | 3/2018 | Nishi et al. | |
| 2018/0267532 | A1 | 9/2018 | Li et al. | |
| 2019/0041233 | A1 * | 2/2019 | Duerksen | G08G 5/0034 |
| 2019/0043368 | A1 | 2/2019 | Priest | |
| 2019/0265705 | A1 | 8/2019 | Zhang et al. | |
| 2019/0315462 | A1 | 10/2019 | Skladman et al. | |
| 2019/0315482 | A1 | 10/2019 | Gu et al. | |
| 2020/0193844 | A1 | 6/2020 | Mahkonen et al. | |
| 2020/0394927 | A1 | 12/2020 | Neubauer et al. | |
| 2021/0053680 | A1 | 2/2021 | Prest et al. | |
| 2021/0159971 | A1 | 5/2021 | Panchal et al. | |

FOREIGN PATENT DOCUMENTS

| | | | |
|---|---|---|---|
| KR | 1020210007366 | A | 1/2021 |
| WO | 2018043820 | A1 | 3/2018 |

* cited by examiner

SYSTEM AND METHOD FOR OPTIMIZING MISSION FULFILLMENT BY UNMANNED AIRCRAFT SYSTEMS (UAS) VIA DYNAMIC ATMOSPHERIC MODELING

CROSS-REFERENCE TO RELATED APPLICATIONS

The present application claims priority under 35 U.S.C. § 120 as a continuation-in-part of co-pending U.S. patent application Ser. No. 17/067,431, filed Oct. 9, 2020 and entitled SYSTEM AND METHOD FOR PREVENTING INADVERTENT LOSS OF SURVEILLANCE COVERAGE FOR AN UNMANNED AERIAL SYSTEM (UAS), which application is in turn a continuation-in-part of U.S. patent application Ser. No. 16/704,742, filed Dec. 5, 2019 and entitled SYSTEM AND METHOD FOR PREVENTING INADVERTENT LOSS OF COMMAND AND CONTROL LINK TO AN UNMANNED AERIAL SYSTEM. Said U.S. patent applications Ser. Nos. 17/067,431 and 16/704,742 are herein incorporated by reference in their entirety.

BACKGROUND

Operating unmanned aerial vehicles (UAVs) beyond visual line of sight (BVLOS) requires that atmospheric conditions, e.g., weather (WX) and wind patterns, remain favorable along the entire course of the flight, which may cover hundreds of miles and last many hours. While it is possible to predict and monitor weather and wind patterns, methods and means do not currently exist for comparing weather patterns to UAV flight plans and generating automated alerts and/or flight plan change recommendations if changing conditions merit doing so. Nothing currently prevents a UAV from departing along its flight plan under favorable conditions and encountering intolerable conditions further along for which the flight plan did not provide.

In addition, flight planning through evolving weather systems can involve multiple sets of variables. Weather systems are dynamic and multidimensional, occupying three-dimensional spaces and moving as time elapses, sometimes along predictable paths and sometimes not. Wind patterns can be modelled at macro and micro levels, but wind speeds may differ significantly as measured on the ground and as experienced by a UAV hundreds or thousands of feet above ground level. Further, favorable wind patterns are crucial if the flight plan involves terrain incorporating large natural or manmade structures, e.g., buildings, mountains and ridges, canyons. Different UAV classes may have different tolerances for weather conditions and operating envelopes. Further, some weather conditions may not necessarily prevent the UAV from flying, but may complicate or preclude successful fulfillment of the UAV's mission.

Currently, responsibility for monitoring the short term and longer-term effects of changing atmospheric conditions on successful flight and mission fulfillment rests with human operators utilizing disparate situational awareness systems, and adapting flight plans and mission objectives to changing weather patterns is dependent upon human intervention. Human analysis and human intervention introduce the possibility of human error, and approaches to flight planning and execution tend to be highly conservative, intentionally limiting UAV operations to err on the side of caution.

SUMMARY

In a first aspect, a method for optimizing fulfillment of mission objectives via unmanned aircraft systems (UAS) is disclosed. In embodiments, the method includes selecting a particular UAS (e.g., based on configuration, onboard equipment, flightworthiness) for fulfillment of a set of mission objectives through a mission space (e.g., an airspace above a defined geographic space) at a flight time subsequent to the time of selection. The method includes receiving, via a UAS controller, an atmospheric model projecting wind patterns and weather systems through the flight time over the mission space, the atmospheric model having an uncertainty factor associated with the accuracy and/or currency of the projection. The method includes, for one or more iterations between the time of selection and the flight time: generating a flight plan providing for fulfillment of the mission objectives through the mission space; determining a probability of successful fulfillment of the mission objectives by simulating an execution of the flight plan by the UAS at the flight time based on the most recent atmospheric model; and revising one or more of the flight time, the flight plan, and/or the atmospheric model for the next iteration. The method includes, based on the determined probability of fulfillment for each iteration, selecting an optimal flight plan and/or flight time for fulfillment of the set of mission objectives by the UAS.

In some embodiments, the method includes revising the day or data of the flight time, or revising the time of day associated with the flight time.

In some embodiments, the method includes revising, pursuant to revising the flight plan, an order of fulfillment in which the set of mission objectives is to be fulfilled.

In some embodiments, the method includes determining a probability of successful navigation of the flight plan by the UAS within authorized airspace constraints, e.g., a model of surveillance quality coverage and/or a model of command and control (C2) link quality based on the flight plan.

In some embodiments, the method includes determining one or more of a probability of satisfactory or complete fulfillment of the set of mission objectives; a probability of partial or equivalent fulfillment of the set of mission objectives; or a probability of failure to fulfill the mission objectives.

In a further aspect, a UAS controller configured for optimizing fulfillment of mission objectives is also disclosed. In embodiments, the controller is configured to receive a set of mission objectives for fulfillment over a mission space by a UAS at a flight time subsequent to the current time. The controller is configured to receive an atmospheric model for the mission space at the flight time, the atmospheric model projecting wind patterns and weather systems through the flight time and having an uncertainty factor (e.g., based on the accuracy and/or currency of the projections). The controller generates a flight plan through the mission space for fulfillment of the mission objectives, based on the most recent atmospheric model. The controller simulates an execution of the flight plan by the UAS at the flight time based on the atmospheric model to determine a probability of successful fulfillment of the mission objectives. Based on the determined probability of fulfillment, the controller selects an optimal flight time and/or flight plan for fulfillment of the mission objectives by the UAS.

In some embodiments, the uncertainty factor is based on the duration between the current time (e.g., the time of the most recent atmospheric model) and the flight time. For example, the more distant the flight time in the future, the higher the level of uncertainty associated with the atmospheric model. In some embodiments, the uncertainty factor is based on the physical distance between a weather or wind model and the UAS (e.g., on the uncertainty associated with the motion of the weather or wind model over time).

In some embodiments, the controller revises the flight plan, the flight time, and/or the atmospheric model (e.g., based on new weather or wind information) for subsequent iterations (e.g., subsequent simulations of the revised flight plan) and determines the probability of fulfillment based on the subsequent simulation/s.

In some embodiments, the controller revises the date and/or the time of day of a simulated execution of the flight plan (e.g., or of the flight itself).

In some embodiments, a flight plan provides for fulfillment of the mission objectives in a particular order of fulfillment, and a revision of the flight plan by the controller includes a revision of the order of fulfillment.

In some embodiments, a probability of fulfillment of mission objectives includes the probability of successful navigation by the UAS of its flight plan within authorized airspace constraints.

In some embodiments, authorized airspace constraints include a model of surveillance quality coverage and/or a model of command and control (C2) link quality coverage (e.g., where the UAS is likely visible to other air traffic and ground control and/or where it can likely maintain a stable and secure C2 datalink vs. where the UAS may not be visible or able to maintain the C2 datalink).

In some embodiments, the probability of fulfillment of mission objectives includes one or more of: the probability that the UAS will satisfactorily or completely fulfill the mission objectives; the probability that the UAS will partially or equivalently fulfill the mission objectives; and/or the probability that the UAS will fail to fulfill the mission objectives.

In some embodiments, the controller includes a communication system for maintaining the C2 datalink between the controller and the UAS, such that the controller receives flight data collected and transmitted inflight by the UAS. For example, flight data may include flight-critical data crucial to the safe operation of the UAS (e.g., operational data, diagnostic data) and/or mission-critical data associated with the fulfillment of mission objectives (e.g., payload data, sensor data). In some embodiments, the controller may revise a probability of fulfillment based on received flight data.

This Summary is provided solely as an introduction to subject matter that is fully described in the Detailed Description and Drawings. The Summary should not be considered to describe essential features nor be used to determine the scope of the Claims. Moreover, it is to be understood that both the foregoing Summary and the following Detailed Description are example and explanatory only and are not necessarily restrictive of the subject matter claimed.

BRIEF DESCRIPTION OF THE DRAWINGS

The detailed description is described with reference to the accompanying figures. The use of the same reference numbers in different instances in the description and the figures may indicate similar or identical items. Various embodiments or examples ("examples") of the present disclosure are disclosed in the following detailed description and the accompanying drawings. The drawings are not necessarily to scale. In general, operations of disclosed processes may be performed in an arbitrary order, unless otherwise provided in the claims. In the drawings:

DETAILED DESCRIPTION

Figure 1:
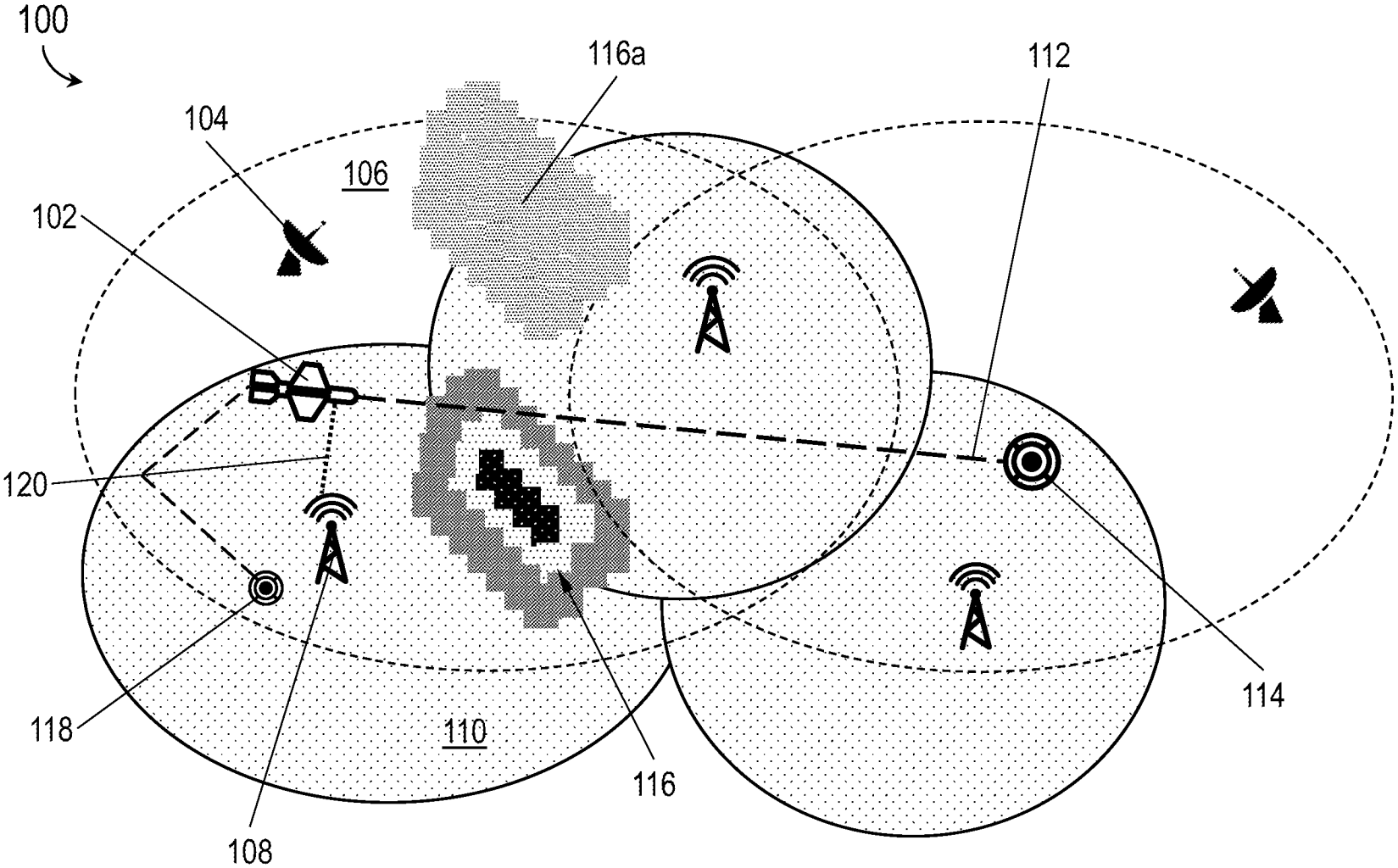
FIG. 1 is a diagrammatic illustration of a mission space for fulfillment of mission objectives by an unmanned aircraft system (UAS) according to example embodiments of this disclosure.

Before explaining one or more embodiments of the disclosure in detail, it is to be understood that the embodiments are not limited in their application to the details of construction and the arrangement of the components or steps or methodologies set forth in the following description or illustrated in the drawings. In the following detailed description of embodiments, numerous specific details may be set forth in order to provide a more thorough understanding of the disclosure. However, it will be apparent to one of ordinary skill in the art having the benefit of the instant disclosure that the embodiments disclosed herein may be practiced without some of these specific details. In other instances, well-known features may not be described in detail to avoid unnecessarily complicating the instant disclosure.

As used herein a letter following a reference numeral is intended to reference an embodiment of the feature or element that may be similar, but not necessarily identical, to a previously described element or feature bearing the same reference numeral (e.g., 1, 1*a*, 1*b*). Such shorthand notations are used for purposes of convenience only and should not be construed to limit the disclosure in any way unless expressly stated to the contrary.

Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of "a" or "an" may be employed to describe elements and components of embodiments disclosed herein. This is done merely for convenience and "a" and "an" are intended to include "one" or "at least one," and the singular also includes the plural unless it is obvious that it is meant otherwise.

Finally, as used herein any reference to "one embodiment" or "some embodiments" means that a particular element, feature, structure, or characteristic described in connection with the embodiment is included in at least one embodiment disclosed herein. The appearances of the phrase "in some embodiments" in various places in the specification are not necessarily all referring to the same embodiment, and embodiments may include one or more of the features expressly described or inherently present herein, or any combination or sub-combination of two or more such features, along with any other features which may not necessarily be expressly described or inherently present in the instant disclosure.

Broadly speaking, embodiments of the inventive concepts disclosed herein are directed to a system and method for long-term optimization and coterminous monitoring of missions carried out by unmanned aircraft systems (UAS). Any given mission executable by a UAS or by a group thereof, from delivery of cargo to high-altitude visual surveillance, may involve flight through a mission airspace over a geographical region. For example, a UAS may launch or takeoff from a predetermined origin point at a start time and touch down at a predetermined destination point at an end time. Between these two points, the UAS may traverse one or more flight plans connecting the origin and destination points, e.g., via a series of intermediate waypoints. Each UAS may be associated with a flight capability associated with, e.g., its class, weight, airworthiness, structural stability, and/or ability to withstand extreme conditions (wind, weather, impact, offensive weaponry). Similarly, each UAS may carry mission payload dedicated to the fulfillment of one or more mission objectives, e.g., cargo to be delivered, equipment for storing and/or delivering said cargo, onboard sensors for performing inspection or surveillance (e.g., of the geographical region or a portion thereof, of natural or manmade features, of other aircraft operating within the mission space). Mission payloads may or may not directly relate to the ability of the UAS to remain airborne, although payloads may otherwise affect the weight, center of gravity, and/or airworthiness of the UAS. Any selection or clarification of a mission element (e.g., candidate UAS, flight plan, order of objectives) prior to flight time may significantly reduce the degree of uncertainty involved in whether the mission can be successfully fulfilled, but some external factors may continue to add uncertainty to the fulfillment probability up to, and after, the launch time.

UAS operating beyond virtual line of sight (BVLOS) in a mission space may be under the control of remote pilots in command (RPIC) via aircraft control facilities distributed throughout the mission space. For example, an RPIC may be stationed at or near a ground-based control facility. While the RPIC may not be able to maintain visual contact with the UAS (hence, BVLOS), the RPIC may remotely operate the UAS via command and control (C2; also, e.g., command, control, and non-payload communications (C3, CNPC)) data links providing for secure two-way transit of control signals (e.g., sent by the RPIC to directly control the UAS) and state data (e.g., sent by the UAS to update the RPIC and control facility as to the current state of the UAS). For example, state data may include flight-critical state data (flight-critical status data), e.g., UAS position, altitude, airspeed, heading, and other avionics/navigation/traffic telemetry data critical to the ability of the RPIC to maintain the UAS in the air along its prescribed flight plan and sufficiently separate from other air traffic or obstacles. State data may also include mission-critical state data, e.g., sensor data indicative of successful surveillance or inspection operations that is not necessarily crucial to the flight capability of the UAS. C2 links may include line-of-sight (LOS) air-to-ground links or BVLOS links, e.g., using satellites or other high-altitude platforms as relay stations. C2 data links may provide for standardized communications protocols (as provided for by, e.g., NATO Standardization Agreement (STANAG) 4586 and/or Radio Technical Commission for Aeronautics (RTCA) DO-362 Minimum Operational Performance Standards (MOPS) for C2 Data Link) and dedicated bandwidth (including, but not limited to, the C-band (5030-5091 MHz) or L-band (960-977 MHz)).

Any given mission presents a broad variety of variables that must be solved for in order for the mission to optimally achieve successful fulfillment. An appropriate UAS must be selected, e.g., based on flight capabilities and/or size, weight, power, and cost (SWaP-C) considerations. Within a particular mission space, a series of objectives to be fulfilled may be arranged in a particular order of fulfillment, and a particular flight plan selected so that the order of fulfillment is followed. Along any path or segment of a particular flight plan various constraints or external factors may affect, complicate, or preclude either the capacity of the UAS to successfully navigate the flight plan or segment and remain airborne within authorized airspace constraints, or the capacity of the UAS to successfully carry out a mission objective, or both. For example, co-pending application Ser. No. 16/704,742, which is herein incorporated by reference in its entirety, discloses a system and method for developing a model of C2 link quality along a flight plan (e.g., based on historical and/or predictive C2 link quality data), for refining said model based on actual C2 link quality data collected inflight, and for responding to significant deviations of link quality from the model. If, for example, C2 link quality were to deteriorate (due to, e.g., terrain conditions, atmospheric conditions, or distance from ground control facilities) or the UAS was unable to restore a lost C2 link, catastrophic loss of the UAS may result. Similarly, co-pending application Ser. No. 17/067,431, which is herein incorporated by reference in its entirety, discloses a system and method for modelling surveillance quality (e.g., the ability of ground control facilities to monitor known air traffic, and detect noncooperative air traffic, along the flight plan and keep the UAS sufficiently informed as to maintain safe separation), for adapting the model to real-time conditions as sensed by the UAS, and responding to unplanned—for deviations in surveillance quality.

Weather (WX) and wind patterns throughout the mission space may affect C2 link quality and surveillance quality as opposed to historical or predictive models, but weather, wind, and other atmospheric conditions may also significantly impact both the ability of the UAS to fulfill its mission objectives and the ability of the UAS to navigate through a selected flight plan within authorized airspace constraints imposed by C2 link quality and/or surveillance quality infrastructure. For example, fog, mist, or precipitation may create a degraded visual environment (DVE) that frustrates or precludes visual inspection or surveillance, e.g., by onboard visible-light cameras of the UAS, while extreme heat may complicate remote thermal imaging by producing excess noise. However, neither of these environmental conditions may directly impair the ability of the UAS to maintain flight, or sufficiently impair the ability of the UAS as to necessitate modification of the flight plan. In addition, depending on the class or flight capabilities of the UAS, high winds, changing wind patterns, or lightning may complicate the ability of the UAS to maintain its flight plan or even remain stable in the air.

Similarly to C2 link quality and surveillance quality, weather and wind patterns over a mission space may be predictively modelled far in advance of a potential launch date. As the launch time approaches, weather forecasts for the launch time generally improve in accuracy, which may positively affect the uncertainty factor associated with weather, wind, and atmospheric conditions. However, while C2 link quality and surveillance quality may be at least partially affected on a consistent bases by the terrain under a mission space, or by the distribution of control infrastructure therewithin, weather systems are four-dimensional in that they occupy a volume while moving, and sometimes evolving, over time. Dynamic weather systems whose positions can be pinpointed with some accuracy at launch time may change position and/or size during the time window corresponding to the flight plan, sometimes predictably and sometimes not.

Referring to FIG. 1, a mission space 100 within which an unmanned aircraft system 102 (UAS) may operate is shown. The mission space 100 may include UAS surveillance control stations 104 operating within surveillance coverage areas 106, UAS command and control (C2) control stations 108 operating within C2 link quality coverage areas 110. The UAS 102 may be navigating according to a flight plan 112 (e.g., flight path) toward touchdown at a landing site 114. The mission space may additionally include weather (Wx) systems 116.

In embodiments, the UAS 102 may operate according to a set of mission objectives. For example, mission objectives may provide that the UAS 102 departs an origin point 118 (e.g., departure point) at a particular flight time (e.g., departure time), carries out operations in fulfillment of the mission objectives within the mission space 100, and touches down at the landing site 114 when all mission objectives have been satisfactorily fulfilled. In embodiments, while in transit between the origin point 118 and the landing site 114, the UAS 102 may maintain a secure two-way C2 data link 120 with C2 stations 108, allowing the UAS to receive control input from a remote pilot in command (RPIC) or to report flight data to the RPIC via the C2 data link 120. For example, the UAS 102 may report, via the C2 data link 120, operational or diagnostic data indicative of the operational health of the UAS, positional data indicative of the position, altitude, heading, and/or attitude of the UAS (and, accordingly, of its adherence to the flight plan 112), and/or sensor data collected aboard the UAS (e.g., if the mission objectives include surveillance or aerial photography, the UAS may report imaging data via the C2 data link).

The flight plan 112 may be developed prior to the departure time and may be based on weather forecasting likewise conducted prior to the departure time. Accordingly, the flight plan 112 may be based on weather forecasting that identifies the weather system 116 in a position (116*a*) well clear of the flight plan; however, the weather forecasting may not be able to account for weather systems or other adverse conditions that develop along, or move into, the flight plan after the departure time.

In embodiments, the presence of the weather system 116 may present a constraint upon the flight plan 112, such that the ability of the UAS 102 to fulfill its assigned mission objectives may be inhibited or precluded entirely. For example, the weather system 116 may include any combination of atmospheric conditions, e.g., wind speeds, precipitation, extremes in temperature, fog/smog/haze, of sufficient significance as to inhibit or prevent the ability of the UAS 102 to navigate its assigned flight plan 112 within authorized airspace constraints. In embodiments, within the mission space 100, authorized airspace constraints on the flight plan 112 may be provided by the surveillance coverage areas 106 and the C2 link quality coverage areas 110, as will be discussed in detail below. Alternatively, the weather system 116 may not sufficiently inhibit or prevent the UAS 102 from navigating the flight plan 112 within authorized airspace constraints, but may complicate the ability of the UAS to fulfill its assigned mission objectives.

In embodiments, given a set of mission objectives to fulfill within the mission space 100, a candidate UAS 102 may be selected for fulfillment of the set of mission objectives at a defined flight time. For example, the flight time may include, but is not limited to: a designated day of departure from the origin point 118, a time of day at which the departure takes place, a time window corresponding to the flight time between the origin point 118 and the landing site 114, and/or a landing time corresponding to the landing of the UAS at the landing site.

In embodiments, the selection of a candidate UAS 102 may be at least partially based on an atmospheric model for mapping atmospheric conditions throughout the mission space 100 during the flight time. The candidate UAS 102 may be selected based on its capability to fulfill the assigned mission objectives; e.g., if the mission objectives include surveillance, a candidate UAS may be equipped with visual, thermal, and/or other sensors capable of performing the required surveillance operations. Further, if several candidate UAS 102 are capable of carrying out the assigned mission objectives, selection of a candidate UAS may incorporate other factors such as fuel efficiency or operational costs. Additionally, the selection of a candidate UAS 102 may be at least partially based on the candidate UAS best able to maintain a flight plan through adverse conditions as provided for by the atmospheric model. For example, if the atmospheric model provides for higher wind speeds throughout all or a portion of the mission space 100, the candidate UAS 102 may ideally be of greater size (or of sufficient structural integrity, or of a sufficiently robust performance envelope) as to safely navigate through above average wind speeds from a variety of directions.

Figure 2:
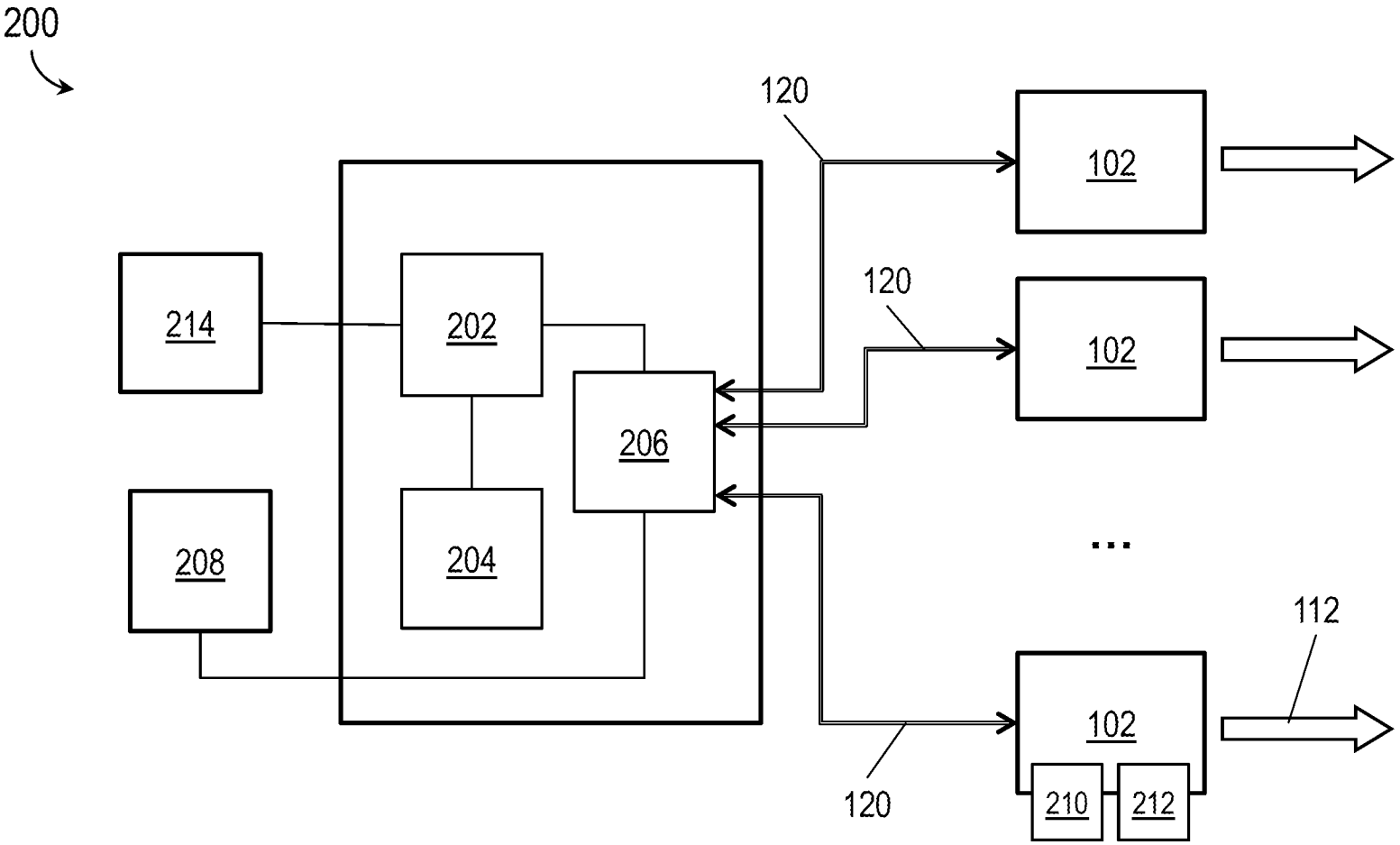
FIG. 2 is a block diagram of a controller of the UAS of FIG. 1.

Referring also to FIG. 2, a controller 200 for managing and monitoring mission fulfillment for one or more UAS 102 within the mission space 100 is shown. The controller 200 may include control processors 202, memory 204, and communications means 206.

In embodiments, the controller 200 may be implemented in a ground-based UAS control facility, e.g., at or near a C2 control station 108 and maintaining C2 data links 120 with any UAS 102 operating within the associated C2 link quality coverage area 110. In some embodiments, the controller 200 may be embodied in a vehicle or other mobile platform, or as a distributed system incorporating one or more ground-based or mobile facilities and/or cloud-based processing or storage.

For example, each UAS may be associated with a unique set of mission objectives and an associated flight plan for fulfilling the set of mission objectives, which may be stored to memory 204 and/or received from an external source 208. For example, when a UAS 102 passes from a first C2 link quality coverage area 110 into a second C2 link quality coverage area, the C2 control station 108 serving the first coverage area may "hand off" the UAS into the control of the C2 control station serving the second coverage area, whereby the C2 control station serving the first coverage area may pass along any mission objectives and/or flight plan information to the C2 control station serving the second coverage area, e.g., if the latter C2 control station does not already have this information.

In embodiments, given a particular set of mission objectives, a candidate UAS 102, and an atmospheric model for the mission space 100 at or during the flight time, one or more flight plans 112 may be generated via which the candidate UAS may depart from the origin point 118, execute any assigned mission objectives or operations, and safely land at the landing site 114. For example, the atmospheric model may be developed at a time prior to the flight time but may attempt to project the weather system 116, as well as any other atmospheric conditions, forward in time through the mission space 100 such that any candidate flight plan 112 may attempt to avoid directing the UAS 102 through any adverse weather or wind conditions of sufficient severity as to constrain the ability of the UAS to either navigate the flight plan or carry out its assigned mission objectives.

In embodiments, the controller 200 may attempt to determine a flight plan 112 and/or a flight time optimizing fulfillment of the set of mission objectives assigned to a UAS 102 by simulating the flight of the UAS based on the most current or accurate atmospheric model available at the time. At any time prior to the departure time of the UAS 102, the controller 200 may model the flight of the UAS along a selected flight plan 112, along with any flight data collected by onboard systems 210 or onboard sensors 212 of the UAS. For example, the controller 200 may compare the simulated airspeed of the UAS 102 to the simulated ground speed to track the effect of wind conditions or other components of the atmospheric model upon the performance of the UAS. Similarly, the controller 200 may simulate sensor input (e.g., visual imagery, thermal imagery) collected by the onboard sensors 212 to determine if conditions predicted by the atmospheric model impair usage of the onboard sensors in furtherance of the set of mission objectives. In some embodiments, simulated sensor input, or other aspects of the simulated execution of the flight plan, may be displayed for a RPIC or other operator by a display unit 214 in communication with the controller 200. For example, impaired visual or thermal sensor data may be indicative of a likely unsuccessful fulfillment of surveillance operations.

In embodiments, an execution of a flight plan 112 by the UAS 102 simulated by the controller 200 may replicate diagnostic, telemetry, or other data collected by onboard systems 210 of the UAS in order to determine the effect of weather or wind conditions predicted by the atmospheric model on the ability of the UAS to navigate the assigned flight plan within authorized airspace constraints (e.g., without escaping surveillance coverage and/or C2 link quality coverage). For example, by replicating the onboard systems 210 and data collected thereby, the controller 200 may attempt to track the simulated position, heading, altitude, attitude, and other aspects of the UAS 102 along the flight plan 112.

Based on the execution of the flight plan 112 by the UAS 102 as simulated by the controller 200, the controller may determine a probability of fulfillment of the assigned set of mission objectives by the UAS based on all available simulated data. For example, the controller 200 may determine a probability that the UAS 102 will successfully navigate the assigned flight plan 112 within authorized airspace constraints.

In embodiments, the controller 200 may determine a probability that the UAS 102 will successfully fulfill the assigned set of mission objectives. For example, the controller 200 may determine a probability of complete fulfillment, partial or equivalent fulfillment, and/or failed fulfillment. For example, complete fulfillment may include the successful execution of every assigned mission objective, e.g., in a predetermined order, according to predetermined time parameters, according to predetermined quality standards. For example, the UAS 102 may successfully depart the origin point 118, perform surveillance operations of a designated area by capturing image data of sufficient quality, and land at its designated landing site 114 within a predetermined time window.

In embodiments, partial or equivalent fulfillment of mission objectives may involve the successful execution of some objectives but not others, or the execution of selected mission objectives according to alternative means. For example, the UAS 102 may successfully conduct surveillance over a first area but not over a second area, e.g., due to a degraded visual environment (DVE) or other atmospheric interference impairing the operations of the onboard sensors 212. Similarly, the UAS 102 may not be able to land at the landing site 114 provided for by its assigned flight plan 112 (e.g., due to adverse weather conditions over the landing site as predicted by the atmospheric model), but may instead successfully land at an alternative landing site with all onboard systems 210, onboard sensors 212, and data collected thereby intact.

In some embodiments, simulated execution of a flight plan 112 may result in complete failure to fulfill any mission objectives due to, e.g., adverse weather conditions or impairments to onboard systems 210 or onboard sensors 212 caused thereby. For example, the UAS 102 (as simulated by the controller 200) may encounter excessive wind speeds that may require an emergency landing ahead of schedule and, while the UAS is able to maintain the flight plan 112, may preclude the capture of accurate sensor imagery (e.g., due to excessive buffeting of the UAS).

In embodiments, based on the determined probabilities of fulfillment associated with an execution of a flight plan 112 by the UAS 102 simulated by the controller 200, the controller 200 may revise one or more aspects of the simulation through multiple iterations prior to the flight time in order to determine optimal conditions for fulfillment of the mission objectives. For example, the atmospheric model may be revised to reflect more current weather and wind forecasting closer to the flight time. The flight plan 112 may be revised to reroute the UAS 102 around potentially adverse weather or wind conditions where possible. The flight time may be revised to avoid adverse weather conditions as predicted by the atmospheric model, or to take advantage of beneficial conditions. For example, the day of a simulated flight, or even the time of day at which a simulated flight commences, occurs, or concludes, may be revised by the controller 200 in order to optimize the probability of complete fulfillment of the set of mission objectives. In some embodiments, the controller 200 may revise the order in which a particular set of mission objectives are to be fulfilled, e.g., if complete fulfillment is not order dependent. For example, if repeated simulations of a flight plan 112 provide for surveillance operations conducted early in the morning, and the simulated surveillance operations are consistently impaired by a DVE (e.g., due to fog), a revised flight plan may provide for conducting surveillance operations later in the flight plan and/or later in the day, when consistently clearer skies and less cloud cover may be predicted by the atmospheric model.

In some embodiments, based on multiple iterations whereby the controller 200 simulates the execution of a flight plan 112 in fulfillment of the set of mission objectives by the UAS 102, and based on determined probabilities of fulfillment associated with each iteration, the controller 200 may select optimal parameters according to which the assigned set of mission objectives may be fulfilled by the UAS. For example, the controller 200 may select an optimal flight plan 112 (e.g., associated with the highest probability of successful fulfillment), an optimal flight time (e.g., date of flight, time of day), an optimal order of fulfillment, and/or other flight parameters. In some embodiments the controller 200 may continue to simulate the execution of the flight plan 112 by the UAS 102 as the actual execution of the flight plan by the UAS commences (e.g., according to the most accurate atmospheric model available at the date or time of flight, projected forward along the flight plan to the extent possible). For example, the controller 200 may guide the UAS 102 along the flight plan 112 (e.g., based on control input from the RPIC) via the C2 data link 120. Coterminously, the UAS 102 may provide the controller 200 with real-time or near real-time flight data collected by onboard systems 210 and onboard sensors 212, which flight data may be used by the controller to enhance the simulated execution of the flight plan 112. If, for example, the simulated execution of the flight plan 112 reveals or suggests potential future impairments to navigation of the flight plan, or to fulfillment of one or more mission objectives, the controller 200 may modify the flight plan and provide appropriate control input to the UAS 102 via C2 data link 120.

Figure 3A:
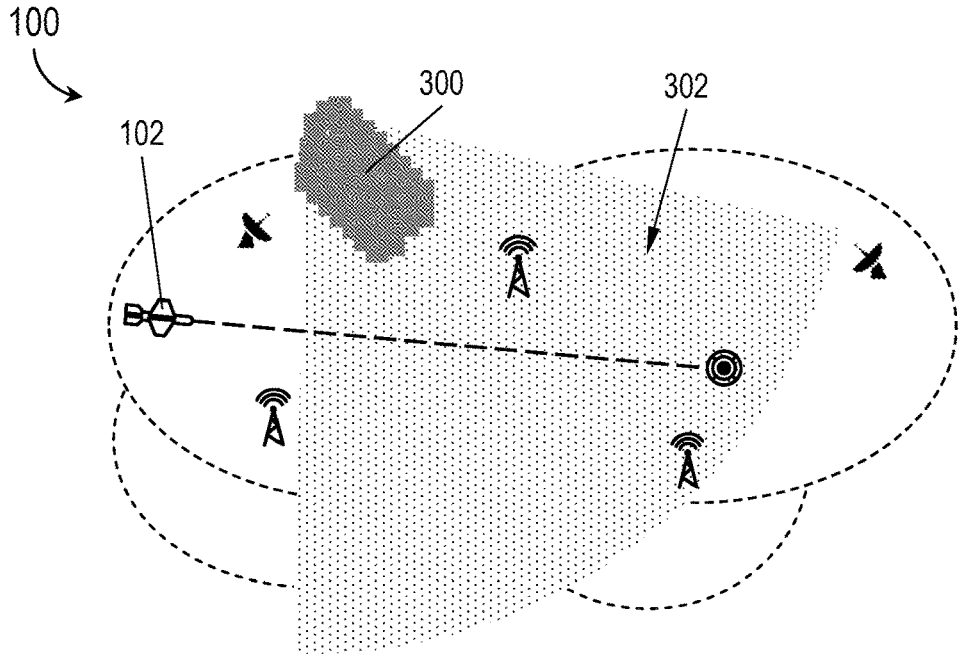
FIGS. 3A and 3B are diagrammatic illustrations of uncertainty factors associated with atmospheric models of the mission space of FIG. 1.

Referring to FIG. 3A, the mission space 100 is shown.

In embodiments, an atmospheric model of the mission space 100 generated or retrieved prior to a potential flight time may be associated with an uncertainty factor, given that the accuracy of any forecast at a current time of wind and weather conditions at a future time may depend on the uncertain and uncontrollable development and movement of weather and wind systems. For example, if the controller (200, FIG. 2) selects, at a current time, a candidate UAS 102 for fulfillment of a given set of mission objectives within the mission space 100 at a future flight time, the accuracy of the atmospheric model may be inversely proportional to its currency, e.g., the longer the distance between the current time and the flight time, the higher the uncertainty factor associated with the atmospheric model. For example, the atmospheric model may identify a potential weather system 300 within the mission space.

In embodiments, an atmospheric model may have a time dimension, e.g., may cover a particular time window or may project wind models and/or weather models forward in time to track their development or movement. While the atmospheric model may provide for the development or movement of the potential weather system 300 in the most general terms, e.g., according to prevailing winds, the potential weather system 300 may be associated with a relatively high zone of uncertainty 302 associated with its possible range of development or movement between the current time and the flight time. Accordingly, any determined probability of fulfillment associated with such an atmospheric model may be weighted by the controller 200 to account for the relatively high uncertainty factor.

Figure 3B:
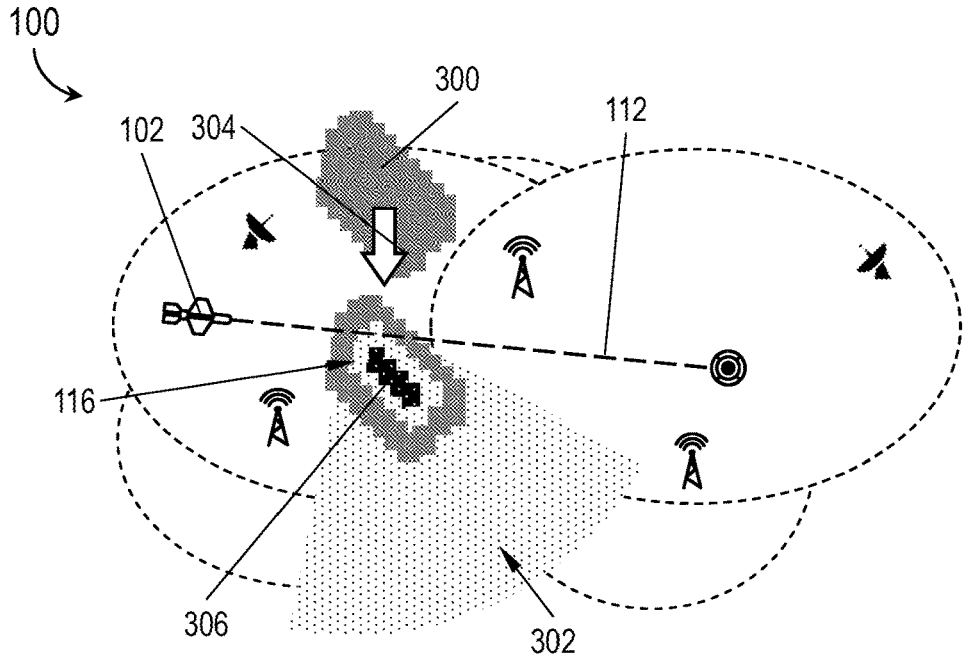

Referring also to FIG. 3B, an atmospheric model generated or retrieved subsequent to the current time (e.g., closer to the flight time) may account for movement and/or development (304) of the potential weather system 300 into a weather system 116, e.g., having a defined core 306 associated with severe or extreme atmospheric conditions that may impair the ability of the UAS to navigate the flight plan 112 within authorized airspace constraints. For example, a subsequent atmospheric model closer to the flight time may be able to place the weather system 116, its core 306, and its remaining zone of uncertainty 302 with greater accuracy. The subsequent atmospheric model may position the weather system 116, core 306, and zone of uncertainty 302 such that neither the core nor the zone of uncertainty may be expected to encroach upon the flight plan 112 while the UAS 102 is nearby, although the UAS may yet encounter or enter the outer portions of the weather system unless corrective modifications are made to the flight plan (e.g., if said modifications are possible within airspace constraints).

Figure 4A:
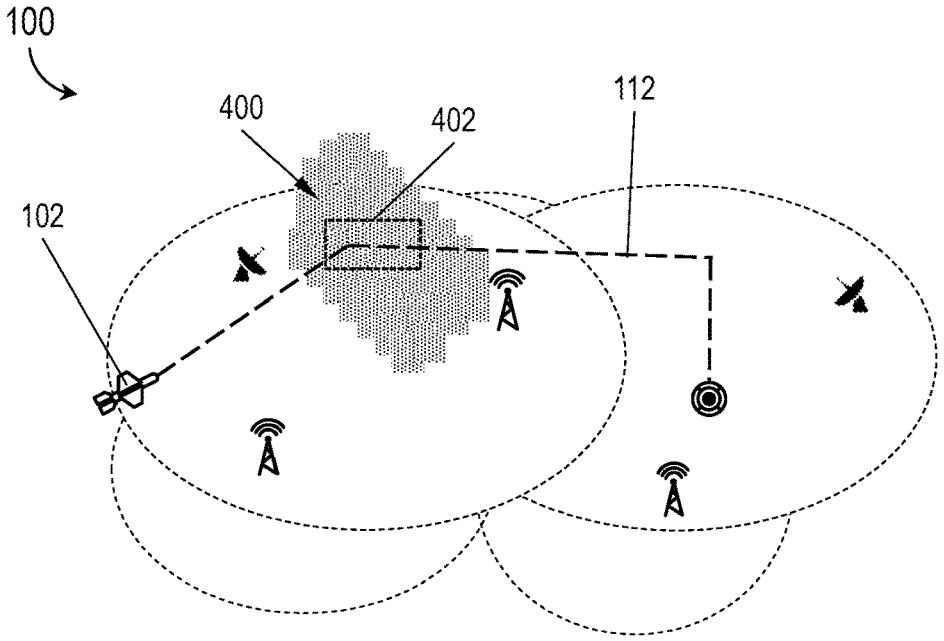
FIGS. 4A and 4B are diagrammatic illustrations of changes in atmospheric models associated with changes in flight time through the mission space by the UAS of FIG. 1.

Referring to FIG. 4A, the mission space 100 is shown.

In embodiments, the controller (200, FIG. 2) may revise the flight time of the UAS 102 in order to optimize the capacity of the UAS to 1) navigate through its flight plan 112 within authorized airspace constraints, 2) fulfill its assigned set of mission objectives, or both. For example, an atmospheric model corresponding to an early morning flight time may indicate a patch of fog 400 within the mission space 100 and encroaching upon the flight plan 112 of the UAS 102. While the atmospheric model may not be indicative of weather or wind conditions along the flight plan 112 that impair the navigational capacity or flightworthiness of the UAS 102, the patch of fog 400 may frustrate the capacity of the UAS (in particular, onboard sensors (212, FIG. 2)) to carry out surveillance operations over the area 402 in the vicinity of the patch of fog.

Figure 4B:
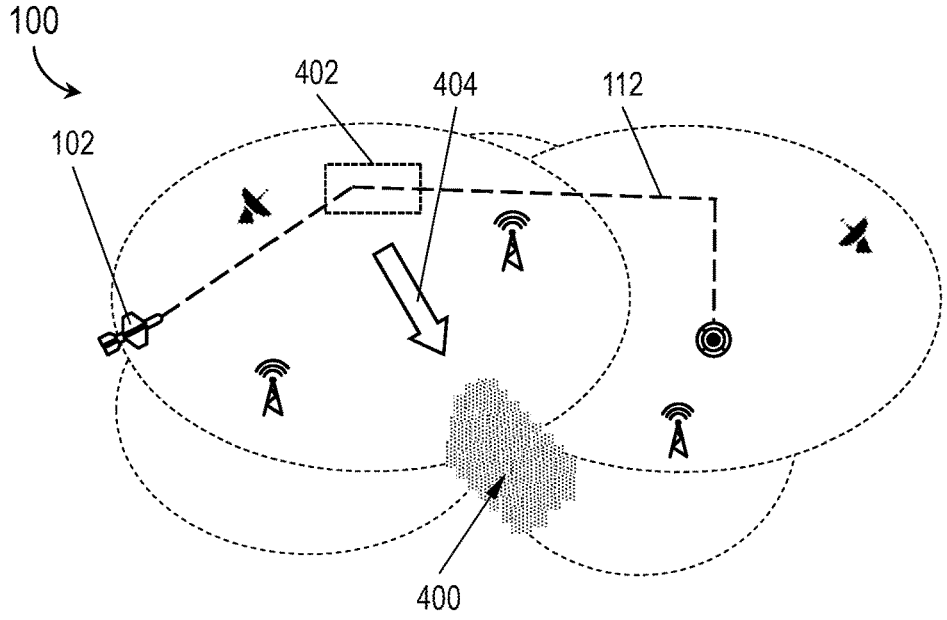

Referring also to FIG. 4B, in embodiments the controller 200 may adjust the flight time of the UAS 102 to a later time of day, such that the patch of fog 400 has either dissipated or moved (404) away from the area 402 when the UAS is navigating through the flight plan 112 and carrying out surveillance operations over the area in furtherance of its assigned set of mission objectives.

Figure 5A:
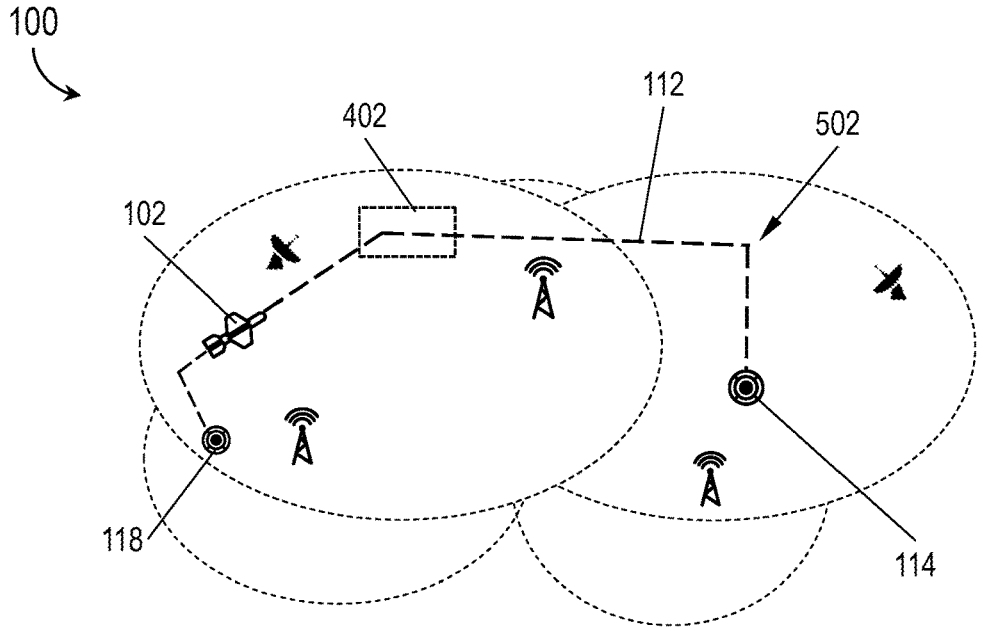
FIGS. 5A and 5B are diagrammatic illustrations of full or partial fulfillment of mission objectives by the UAS of FIG. 1.

Referring to FIG. 5A, the mission space is shown.

In embodiments, a simulated execution by the controller (200, FIG. 2) of the flight plan 112 by the UAS 102 through the mission space 100 may result in a probability of fulfillment of the set of mission objectives assigned to the UAS, as determined by the controller. For example, the controller 200 may determine a probability distribution indicating the likelihood of full or complete fulfillment of the mission objectives, partial or equivalent fulfillment of the mission objectives, or complete failure to fulfill the mission objectives.

In embodiments, the flight plan 112 may provide that the UAS 102 depart from the origin point 118, perform surveillance operations over the area 402, change course (502), and land at the landing site 114. Should the UAS 102 navigate along its flight plan 112 above a threshold level of accuracy (e.g., below a threshold level of divergence from the flight plan), execute any associated mission operations above a threshold level of completion (e.g., and in the proper order, for any order-dependent operations), and arrive at the landing site 114 within appropriate time parameters (e.g., without undue or otherwise unexplained delay), the flight plan 112 may be associated by the controller 200 with a high probability of complete fulfillment. Further, the controller 200 may weight such a flight plan 112 favorably in selecting an optimal flight plan (e.g., or flight time, or any other appropriate selectable parameters) for fulfillment of the mission objectives.

Figure 5B:
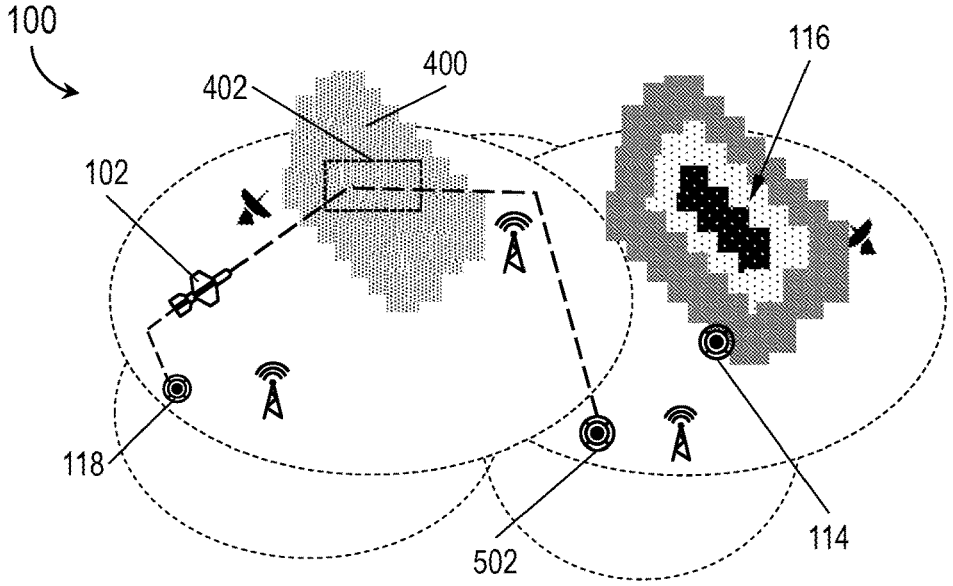

In embodiments, referring also to FIG. 5B, the UAS 102 (as simulated by the controller 200) may encounter difficulty in achieving complete fulfillment of its assigned mission objectives. For example, the UAS 102 may depart the origin point 118 at an appropriate flight time, but may encounter fog (400) over an area 402 designated for overhead surveillance operations, such that the onboard sensors (212, FIG. 2) of the UAS are unable to complete surveillance operations to a threshold level of accuracy (e.g., due to insufficient clarity of some, but not all, imagery captured by the onboard sensors). Similarly, the UAS 102 may encounter a weather system 116 preventing the UAS from safely approaching or landing at the landing site 114 as provided for by the flight plan 112. However, the controller 200 may be able to modify the flight plan 112 and redirect the UAS 102 to an alternative landing site 502 with minimal delay. Accordingly, the controller 200 may, in determining a probability of fulfillment, consider mission objectives associated with surveillance operations to be partially fulfilled (e.g., captured imagery was partially usable and partially of insufficient clarity) and mission objectives associated with landing to be equivalently fulfilled (e.g., a landing was achieved within acceptable time parameters, but at an alternative landing site 502). With respect to the full set of mission objectives, the controller 200 may associate the highest probability with partial, rather than complete, fulfillment of the mission objectives.

Figure 6A:
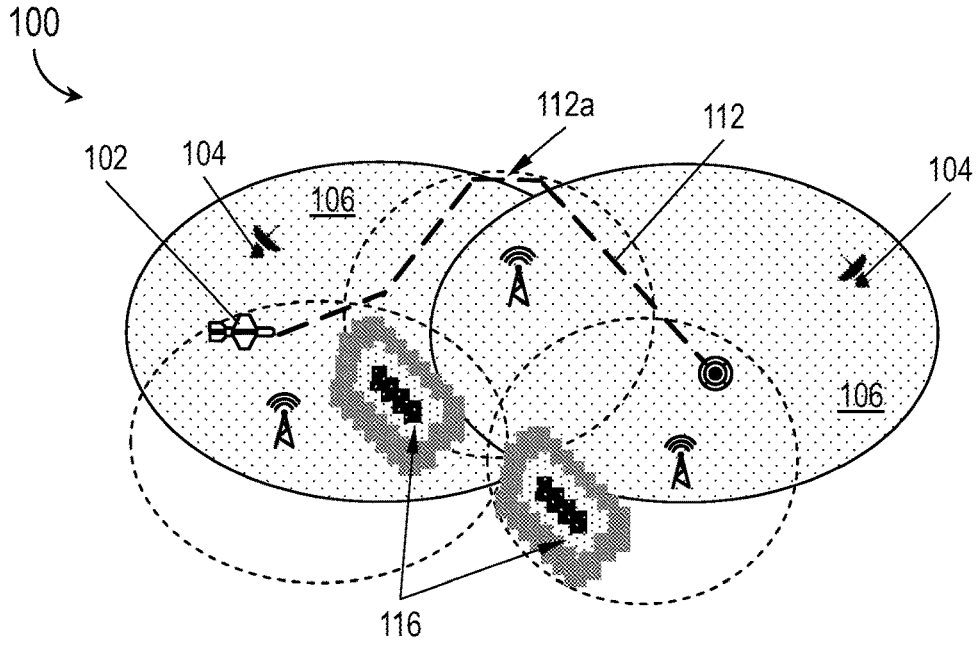
FIGS. 6A and 6B are diagrammatic illustrations of navigation of a flight plan within authorized airspace constraints by the UAS of FIG. 1.

Referring now to FIG. 6A, the mission space 100 is shown.

In embodiments, when simulating execution of a flight plan 112 by the UAS 102, the controller 200 may modify the flight plan to redirect the UAS away from weather systems 116 that may impair the capacity of the UAS to fulfill its assigned set of mission objectives or that may threaten the flightworthiness of the UAS. However, in modifying the flight plan 112, the controller 200 may attempt to avoid escaping authorized airspace constraints. For example, the surveillance control stations 104 may operate within respective surveillance coverage areas 106, enabling the UAS 102 to see and be seen with respect to other proximate air traffic within the surveillance coverage area. In embodiments, the remote pilot in command (RPIC) may periodically report the position of the UAS 102 to surveillance control stations 104, which may in turn provide periodic traffic reports of any air traffic having the potential to encroach upon the flight plan 112 and present a collision threat to the UAS. For example, if the modified flight plan (112*a*) directs the UAS 102 outside the surveillance coverage areas 106, the UAS may lose the ability to maintain spatial separation with proximate air traffic and the probability of fulfillment of mission objectives (as well as the safe operation of the UAS) may be adversely affected.

Figure 6B:
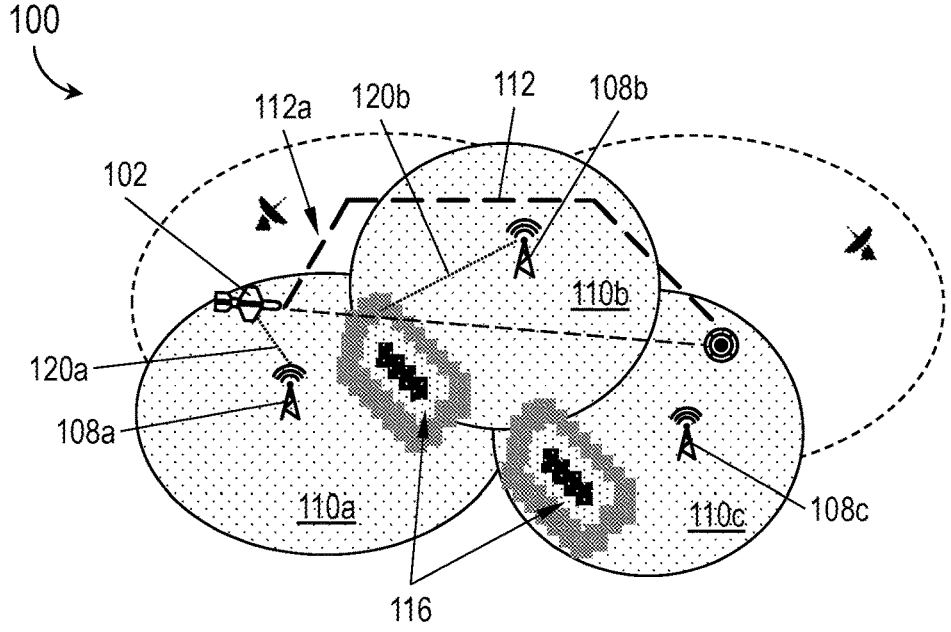

Similarly, referring also to FIG. 6B, the C2 control stations 108*a-c* may operate within respective C2 link quality coverage areas 110*a-c* and maintain C2 data links between the UAS 102 and the RPIC throughout the length of the flight plan 112. For example, when the flight plan 112 crosses from a first C2 link quality coverage area 110*a* into a second C2 link quality coverage area 110*b*, the respective C2 control stations 108 may collaborate to seamlessly "hand off" the UAS 102 from the control of one C2 control station 108*a* to the control of another C2 control station 108*b*, such that the secure C2 data links 120*a-b* are maintained without interruption. If, however, a modified flight plan 112*a* (e.g., modified to redirect the UAS 102 away from weather systems 116) necessarily redirects the UAS 102 away from the C2 link quality coverage areas 110*a-c*, the ability of the RPIC to maintain a seamless and secure C2 data link 120*a-b* to the UAS 102, and thereby safely control flight operations of the UAS, may be compromised. Accordingly, the probability of fulfillment of mission objectives (as well as the safe operation of the UAS) may be adversely affected, likely below an acceptable threshold level.

Figure 7:
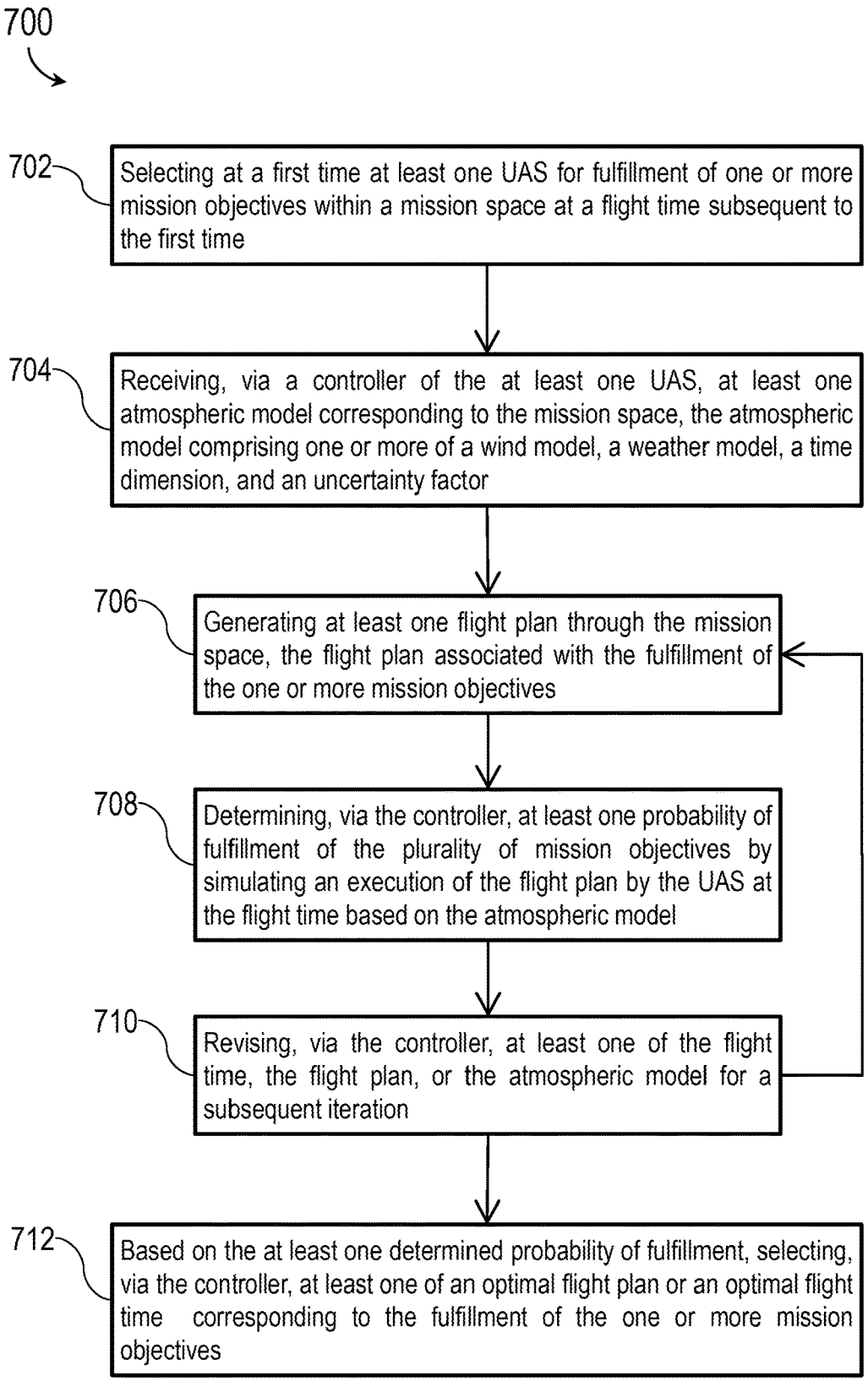
FIG. 7 is a flow diagram illustrating a method for optimizing fulfillment of mission objectives in a mission space by a UAS according to example embodiments of this disclosure.

Referring to FIG. 7, a method 700 may be implemented by the controller 200 and may include the following steps.

At a step 702, a UAS is selected for fulfillment of one or more mission objectives within a mission space above a geographical region, at a flight time subsequent to the time of selection. For example, the mission objectives may be in sequential order or at least partially order-dependent, e.g., to minimize flight duration or based on the location of launch and landing facilities. The UAS may be selected based on its flight capabilities (e.g., class, weight, tolerance for adverse conditions) and may include cargo or onboard equipment (e.g., sensors, cameras) necessary for carrying out the mission objectives. The selection of a UAS (e.g., from a pool of various candidate UAS of diverse class, capability, or configuration) may be at a selection time in advance of the actual flight time (e.g., launch time) associated with the mission.

At a step 704, the controller generates (or receives from an external source) an atmospheric model forecasting weather and/or wind conditions over the mission space. For example, the atmospheric model may correspond to a flight time or departure time (e.g., whereby the UAS would commence fulfillment of mission objectives) and may project weather and wind forecasts forward through time in order to forecast conditions for possible flight plans through the mission space. The atmospheric model may be associated with an uncertainty factor. For example, based on the time distance between the forecast time and the flight time (e.g., two weeks prior, one week prior, two days prior) atmospheric models may be associated with a quantified level of uncertainty (or, e.g., the likelihood that the forecast may change, and to what extent, before the projected flight time). Atmospheric models may project the locations of weather systems and wind patterns as well as the potential movement of said systems and patterns prior to flight time and/or during the flight proper.

Steps 706 through 710 may be carried out iteratively, e.g., between the time of selection and the flight time (if a flight time has been set).

At a step 706, a flight plan through the mission space is generated by the controller, based on the associated set of mission objectives to be fulfilled. For example, the flight plan may provide for flight by the UAS along one or more flight plans or plan segments through the mission space, from origin to destination (which paths or segments may be in sequence, connected via a series of waypoints), and within a time window (e.g., from a projected departure time to a projected landing time), the flight plans allowing the UAS to fulfill its mission objectives along the way.

At a step 708, the execution of the flight plan by the selected UAS is simulated by the controller based on the most accurate available atmospheric model for the mission space. For example, the flight plan of the UAS may be simulated as accurately as possible by replicating the behavior of onboard systems and sensors in response to projected atmospheric conditions, and may include full or partial visualization (e.g., overhead tactical/navigational display or from the perspective of the UAV (e.g., showing the location of the UAS within the mission space, the associated terrain, potential air traffic, as well as areas of high or low C2 link quality, high or low surveillance quality, and projected weather systems and wind patterns). Based on the executed simulation and conditions observed therein, a probability distribution of successful mission fulfillment may be determined for the selected flight plan. In some embodiments, probability of fulfillment includes the probability of the UAS successfully navigating its assigned flight plan within authorized airspace constraints (e.g., without modifying the flight plan to escape areas of secure C2 data link quality between the controller and the UAS, or areas of traffic/surveillance coverage). In some embodiments, probability of fulfillment includes the probability that the UAS will completely fulfill its assigned mission objectives, that the UAS will partially or equivalently fulfill its assigned mission objectives, or that the UAS will fail to fulfill its assigned mission objectives.

At a step 710, based on the executed simulation, the controller may revise one or more aspects of the simulated flight plan for a subsequent simulation, e.g., with the intent of increasing the fulfillment probability (with respect to navigational capability and/or mission objective fulfillment). For example, the flight plan may be revised to avoid potential obstacles or low coverage areas; the day or time of flight may be revised, e.g., to avoid darkness, precipitation, or excess wind; or the atmospheric models may be revised based on updated weather and wind forecasts.

At a step 712, based on multiple simulations incorporating different input variables, the controller selects an optimal flight plan and/or flight time to optimize fulfillment of the assigned set of mission objectives. For example, a flight plan and/or flight time may be selected based on the highest fulfillment probability associated with either fulfillment of mission objectives or navigational capability.

CONCLUSION

It is to be understood that embodiments of the methods disclosed herein may include one or more of the steps described herein. Further, such steps may be carried out in any desired order and two or more of the steps may be carried out simultaneously with one another. Two or more of the steps disclosed herein may be combined in a single step, and in some embodiments, one or more of the steps may be carried out as two or more sub-steps. Further, other steps or sub-steps may be carried in addition to, or as substitutes to one or more of the steps disclosed herein.

Although inventive concepts have been described with reference to the embodiments illustrated in the attached drawing figures, equivalents may be employed and substitutions made herein without departing from the scope of the claims. Components illustrated and described herein are merely examples of a system/device and components that may be used to implement embodiments of the inventive concepts and may be replaced with other devices and components without departing from the scope of the claims. Furthermore, any dimensions, degrees, and/or numerical ranges provided herein are to be understood as non-limiting examples unless otherwise specified in the claims.

We claim:

1. A method for optimizing mission fulfillment via unmanned aircraft systems (UAS), the method comprising:

selecting at a first time at least one UAS for fulfillment of one or more mission objectives within a mission space at a flight time subsequent to the first time;

receiving, via a controller of the at least one UAS, at least one atmospheric model corresponding to the mission space, the atmospheric model comprising one or more of a wind model, a weather model, a time dimension, and an uncertainty factor;

for at least one iteration between the first time and the flight time:

generating at least one flight plan through the mission space, the flight plan associated with the fulfillment of the one or more mission objectives;

determining, via the controller, at least one probability of fulfillment of the plurality of mission objectives by simulating an execution of the flight plan by the UAS at the flight time based on the atmospheric model;

and revising, via the controller, at least one of the flight time, the flight plan, or the atmospheric model for a subsequent iteration;

and based on the at least one determined probability of fulfillment, selecting, via the controller, at least one of an optimal flight plan or an optimal flight time corresponding to the fulfillment of the one or more mission objectives.

2. The method of claim 1, wherein revising, via the controller, at least one of the flight time, the flight plan, or the atmospheric model for a subsequent iteration includes:

revising a date associated with the execution of the flight plan;

or revising a time of day associated with the execution of the flight plan.

3. The method of claim 1, wherein:

the at least one flight plan provides for the fulfillment of the one or more mission objectives in an order of fulfillment;

and wherein revising the at least one flight plan includes revising the order of fulfillment.

4. The method of claim 1, wherein determining, via the controller, at least one probability of fulfillment of the plurality of mission objectives by simulating an execution of the flight plan by the UAS at the flight time based on the atmospheric model includes determining at least one probability of successful navigation of the flight plan within one or more authorized airspace constraints including one or more of:

a surveillance quality coverage model associated with the flight plan;

or a command and control (C2) link quality model associated with the flight plan.

5. The method of claim 1, wherein determining, via the controller, at least one probability of fulfillment of the plurality of mission objectives by simulating an execution of the flight plan by the UAS at the flight time based on the atmospheric model includes determining at least one of:

a probability associated with a satisfactory fulfillment of the plurality of mission objectives;

a probability associated with a partial fulfillment of the plurality of mission objectives;

or a probability associated with failure to fulfill the plurality of mission objectives.

6. A controller configured for optimizing mission fulfillment by unmanned aircraft systems (UAS), comprising:

one or more processors configured to execute a set of program instructions stored in memory, the set of program instructions configured to cause the one or more processors to:

receive, at a current time:

a plurality of mission objectives for execution by at least one UAS, the plurality of mission objectives associated with a mission space;

a flight time subsequent to the current time;

and at least one atmospheric model corresponding to the mission space, the atmospheric model comprising one or more of a wind model, a weather model, a time dimension, and an uncertainty factor;

generate at least one flight plan through the mission space, the flight plan configured for fulfillment of the plurality of mission objectives;

determine at least one probability of fulfillment of the plurality of mission objectives by simulating an execution of the at least one flight plan by the at least one UAS at the flight time based on the at least one atmospheric model;

and based on the determined probability of fulfillment, select one or more of an optimal flight plan or an optimal flight time for fulfillment of the plurality of mission objectives by the at least one UAS.

7. The controller of claim 6, wherein:

the uncertainty factor is associated with one or more of:

a duration between the current time and the flight time;

or a physical distance between the UAS and the atmospheric model.

8. The controller of claim 6, wherein the set of program instructions is further configured to cause the one or more processors to:

based on a first determining of the probability of fulfillment, revise one or more of the flight plan, the flight time, or the atmospheric model;

and determine at least one second probability of fulfillment of the plurality of mission objectives based on the revised flight plan, the revised flight time, or the revised atmospheric model.

9. The controller of claim 8, wherein revising the flight time includes one or more of:

revising a date associated with execution of the flight plan;

or revising a time of day associated with execution of the flight plan.

10. The controller of claim 8, wherein:

the at least one flight plan is configured for fulfillment of the plurality of mission objectives according to an order of fulfillment;

and revising the at least one flight plan includes revising the order of fulfillment.

11. The controller of claim 6, wherein the at least one probability of fulfillment of the plurality of mission objectives includes a probability of successful navigation of the flight plan within one or more authorized airspace constraints.

12. The controller of claim 11, wherein the one or more authorized airspace constraints include one or more of:

a surveillance quality coverage model associated with the flight plan;

or a command and control (C2) link quality model associated with the flight plan.

13. The controller of claim 6, wherein the at least one probability of fulfillment of the plurality of mission objectives includes one or more of:

a probability associated with a satisfactory fulfillment of the plurality of mission objectives;

a probability associated with a partial fulfillment of the plurality of mission objectives;

or a probability associated with failure to fulfill the plurality of mission objectives.

14. The controller of claim 6, further comprising:

communications means for maintaining a command and control (C2) datalink between the controller and the UAS, the communications means configured for:

receiving, at a time subsequent to the optimal flight time, flight data sensed by the UAS via the C2 datalink, the flight data including one or more of 1) flight-critical flight data and 2) mission-critical flight data;

and revising the probability of fulfillment of the plurality of mission objectives based on the received flight data.

* * * * *